US011735130B2

(12) United States Patent
Hai

(10) Patent No.: US 11,735,130 B2
(45) Date of Patent: Aug. 22, 2023

(54) WHITE BALANCE ADJUSTING METHOD AND ELECTRONIC EQUIPMENT

(71) Applicant: Shenzhen China Star Optoelectronics Semiconductor Display Technology Co., Ltd., Shenzhen (CN)

(72) Inventor: Bo Hai, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/253,450

(22) PCT Filed: Aug. 4, 2020

(86) PCT No.: PCT/CN2020/106851

§ 371 (c)(1),
(2) Date: Dec. 17, 2020

(87) PCT Pub. No.: WO2022/007080

PCT Pub. Date: Jan. 13, 2022

(65) Prior Publication Data

US 2023/0119610 A1 Apr. 20, 2023

(30) Foreign Application Priority Data

Jul. 7, 2020 (CN) ..... 202010647751.8

(51) Int. Cl.
*G09G 3/36* (2006.01)

(52) U.S. Cl.
CPC ... *G09G 3/3607* (2013.01); *G09G 2300/0452* (2013.01); *G09G 2320/0626* (2013.01); *G09G 2320/0666* (2013.01); *G09G 2320/0673* (2013.01); *G09G 2320/0693* (2013.01); *G09G 2330/12* (2013.01); *G09G 2360/16* (2013.01)

(58) Field of Classification Search
CPC ..... G09G 3/3607; G09G 2300/0452; G09G 2320/0626; G09G 2320/0666; G09G 2320/0693; G09G 2330/12; G09G 2360/16
See application file for complete search history.

(56) References Cited

U.S. PATENT DOCUMENTS

| | | | | |
|---|---|---|---|---|
| 10,679,544 | B2 * | 6/2020 | Van Belle | G09G 5/10 |
| 2007/0236517 | A1 | 10/2007 | Kimpe | |
| 2018/0240415 | A1 | 8/2018 | Chen | |

FOREIGN PATENT DOCUMENTS

| | | | |
|---|---|---|---|
| CN | 1942916 | A | 4/2007 |
| CN | 103021316 | A | 4/2013 |
| CN | 103366709 | A | 10/2013 |

(Continued)

*Primary Examiner* — Kenneth B Lee, Jr.
(74) *Attorney, Agent, or Firm* — Nathan & Associates; Menachem Nathan

(57) ABSTRACT

The disclosure provides a white balance adjusting method, device, and electronic equipment. The method includes obtaining a first image parameter of a panel under test; obtaining a white balance compensation factor of the panel under test; using a gamma value of the panel under test as a first threshold value to obtain a first target luminance of the panel under test; obtaining a second target luminance of the panel under test; and obtaining grayscale voltages corresponding to sub-pixels of the panel under test based on the second target luminance of the panel under test.

10 Claims, 4 Drawing Sheets

(56) References Cited

FOREIGN PATENT DOCUMENTS

| | | | |
|---|---|---|---|
| CN | 103366710 | A | 10/2013 |
| CN | 104751756 | A | 7/2015 |
| CN | 106023929 | A | 10/2016 |
| CN | 106782303 | A | 5/2017 |
| CN | 109410889 | A | 3/2019 |
| CN | 110223650 | A | 9/2019 |
| CN | 110491348 | A | 11/2019 |
| CN | 111583884 | A | 8/2020 |
| JP | 2005079623 | A | 3/2005 |
| JP | 2008306431 | A | 12/2008 |
| KR | 20050110489 | A | 11/2005 |

* cited by examiner

WHITE BALANCE ADJUSTING METHOD AND ELECTRONIC EQUIPMENT

CROSS REFERENCE TO RELATED APPLICATIONS

The disclosure claims priority to International Application No. PCT/CN2020/106851, filed on Aug. 4, 2020, titled "WHITE BALANCE ADJUSTING METHOD, DEVICE, AND ELECTRONIC EQUIPMENT" which claims priority to Chinese patent application No. 202010647751.8, titled "WHITE BALANCE ADJUSTING METHOD, DEVICE, AND ELECTRONIC EQUIPMENT", filed with the National Intellectual Property Administration on Jul. 7, 2020, which is incorporated by reference in the present application in its entirety.

BACKGROUND OF INVENTION

Field of Invention

The present invention relates to a technical field of display technologies, and more particularly, to a white balance adjusting method, device, and electronic equipment.

Description of Prior Art

Due to drivers and characteristics and other factors of liquid crystal display (LCD) panels, LCDs may suffer from a substantial degree of color deviation in grayscale color performance during white balance operations. To achieve a certain degree of color accuracy and consistency of the display, it is necessary to adjust grayscale white balance of the display step by step.

In current displays, when RGB sub-pixels are displayed individually, low voltages corresponding to two sub-pixels in a low grayscale state can affect high voltages of sub-pixels in a high grayscale state, resulting in a decrease in brightness of one of RGB sub-pixels. When W sub-pixel is displayed, the RGB sub-pixels are fully lit, which means that the three RGB sub-pixels correspond to the high voltage, and the influence on the brightness between the three RGB sub-pixels is small. That is, W has high luminance. Therefore, in current displays, when all of the WRGB sub-pixels are all in a given grayscale, the luminance of W is not equal to a sum of the luminance of the three RGB sub-pixels, which affects display quality of the display.

Hence, a white balance adjustment method is required to solve the above technical problems.

SUMMARY OF INVENTION

Technical Problems

The present application provides a white balance adjusting method, device, and electronic equipment to address the low display quality of current displays.

Technical Solutions

The present application provides a white balance adjusting method comprising:

obtaining a first image parameter of a panel under test;

obtaining a white balance compensation factor of the panel under test based on the first image parameter of the panel under test;

using a gamma value of the panel under test as a first threshold value to obtain a first target luminance of the panel under test;

obtaining a second target luminance of the panel under test based on the white balance compensation factor and the first target luminance of the panel under test; and obtaining grayscale voltages corresponding to sub-pixels of the panel under test based on the second target luminance of the panel under test.

In the white balance adjusting method, the step of obtaining the first image parameter of the panel under test comprises:

scanning the panel under test to obtain a luminance value $L_R(i)$ of an R sub-pixel, a luminance value $L_G(i)$ of a G sub-pixel, a luminance value $L_B(i)$ of a B sub-pixel, and a luminance value $L_W(i)$ of a W sub-pixel of the panel under test at an i-th gray level.

In the white balance adjusting method, the step of obtaining the white balance compensation factor of the panel under test based on the first image parameter of the panel under test comprises:

obtaining a luminance value $L_R(M)$ of an R sub-pixel, a luminance value $L_G(M)$ of a G sub-pixel, a luminance value $L_B(M)$ of a B sub-pixel, and a luminance value $L_W(M)$ of a W sub-pixel of the panel under test at an M-th gray level;

obtaining a luminance value $L_R(n)$ of an R sub-pixel, a luminance value $L_G(n)$ of a G sub-pixel, a luminance value $L_B(n)$ of a B sub-pixel, and a luminance value $L_W(n)$ of a W sub-pixel of the panel under test at an n-th gray level;

obtaining a luminance value $L_P$ of a pixel of the panel under test at a dim state;

obtaining a compensation factor $a=\{(L_R(M)+L_R(M)+L_R(M)-2L_P)/L_W(M)\}/\{(L_R(n)+L_R(n)+L_R(n)-2L_P)/L_W(n)\}$ of the panel under test at the n-th gray level;

wherein n is an integer among zero to M.

In the white balance adjusting method, the step of using the gamma value of the panel under test as the first threshold value to obtain the first target luminance of the panel under test comprises:

using the gamma value of the panel under test as the first threshold value to obtain the first target luminance of the panel under test; and normalizing the first target luminance to obtain a first normalized target luminance of the panel under test.

In the white balance adjusting method, the step of obtaining the second target luminance of the panel under test based on the white balance compensation factor and the first target luminance of the panel under test comprises:

obtaining a second normalized target luminance of the panel under test based on a ratio of the first normalized target luminance and the white balance compensation factor of the panel under test.

In the white balance adjusting method, before the step of obtaining the grayscale voltages corresponding to sub-pixels of the panel under test based on the second target luminance of the panel under test, the method further comprises:

converting the first image parameter of the panel under test from a low bit depth to a high bit depth using a first function to obtain a second image parameter of the panel under test.

In the white balance adjusting method, the step of obtaining the grayscale voltages corresponding to sub-pixels of the panel under test based on the second target luminance of the panel under test comprises:

obtaining corresponding luminance values of a first sub-pixel among RGB sub-pixels of the panel under test at gray levels based on the second normalized target luminance of the panel under test;

obtaining corresponding luminance values of a second sub-pixel and a third sub-pixel among RGB sub-pixels of the panel under test at gray levels based on the corresponding luminance values of the first sub-pixel at gray levels and the second image parameter of the panel under test;

obtaining grayscale voltages for the first sub-pixel, second sub-pixel, and the third sub-pixel at gray levels based on the corresponding luminance values of first sub-pixel, the second sub-pixel, and the third sub-pixel at gray levels.

wherein the first sub-pixel, the second sub-pixel, and the third sub-pixel are different ones of an R sub-pixel, a G sub-pixel, and a B sub-pixel of the panel under test.

The present application provides a white balance adjusting device comprising a capture module, a compensation module, a first luminance calculation module, a second luminance calculation module, and an adjusting module. The capture module obtains a first image parameter of a panel under test. The compensation module obtains a white balance compensation factor of the panel under test based on the first image parameter of the panel under test. The first luminance calculation module uses a gamma value of the panel under test as a first threshold value to obtain a first target luminance of the panel under test. The second luminance calculation module obtains a second target luminance of the panel under test based on the white balance compensation factor and the first target luminance of the panel under test. The adjusting module obtains grayscale voltages corresponding to sub-pixels of the panel under test based on the second target luminance of the panel under test.

In the white balance adjusting device, the compensation module comprises a first capture unit, a second capture unit, a dim state luminance calculation unit, and a compensation unit. The first capture unit obtains a luminance value $L_R(M)$ of an R sub-pixel, a luminance value $L_G(M)$ of a G sub-pixel, a luminance value $L_B(M)$ of a B sub-pixel, and a luminance value $L_W(M)$ of a W sub-pixel of the panel under test at an M-th gray level. The second capture unit obtains a luminance value $L_R(n)$ of an R sub-pixel, a luminance value $L_G(n)$ of a G sub-pixel, a luminance value $L_B(n)$ of a B sub-pixel, and a luminance value $L_W(n)$ of a W sub-pixel of the panel under test at an n-th gray level. The dim state luminance calculation unit obtains a luminance value $L_P$ of a pixel of the panel under test at a dim state. The compensation unit obtains a compensation factor $a=\{(L_R(M)+L_R(M)+L_R(M)-2L_P)/L_W(M)\}/\{(L_R(n)+L_R(n)+L_R(n)-2L_P)/L_W(n)\}$ of the panel under test at the n-th gray level. The n is an integer among zero to M.

In the white balance adjusting device, the first luminance calculation module comprises a first target luminance calculation module and a first normalizing unit. The first target luminance calculation module uses the gamma value of the panel under test as the first threshold value to obtain the first target luminance of the panel under test. The first normalizing unit normalizes the first target luminance to obtain a first normalized target luminance of the panel under test.

In the white balance adjusting device, the second target luminance calculation module obtains a second normalized target luminance of the panel under test based on a ratio of the first normalized target luminance and the white balance compensation factor of the panel under test.

In the white balance adjusting device, the capture module scans the panel under test to obtain a luminance value $L_R(i)$ of an R sub-pixel, a luminance value $L_G(i)$ of a G sub-pixel, a luminance value $L_B(i)$ of a B sub-pixel, and a luminance value $L_W(i)$ of a W sub-pixel of the panel under test at an i-th gray level.

The white balance adjusting device further comprises a bit depth converting module which converts the first image parameter of the panel under test from a low bit depth to a high bit depth using a first function to obtain a second image parameter of the panel under test.

In the white balance adjusting device, the adjusting module comprises a first calculation unit, a second calculation unit, and a third calculation unit. The first calculation unit obtains corresponding luminance values of a first sub-pixel among RGB sub-pixels of the panel under test at gray levels based on the second normalized target luminance of the panel under test. The second calculation unit obtains corresponding luminance values of a second sub-pixel and a third sub-pixel among RGB sub-pixels of the panel under test at gray levels based on the corresponding luminance values of the first sub-pixel at gray levels and the second image parameter of the panel under test. The third calculation unit obtains grayscale voltages for the first sub-pixel, second sub-pixel, and the third sub-pixel at gray levels based on the corresponding luminance values of first sub-pixel, the second sub-pixel, and the third sub-pixel at gray levels. The first sub-pixel, the second sub-pixel, and the third sub-pixel are different ones of an R sub-pixel, a G sub-pixel, and a B sub-pixel of the panel under test.

The present application provides an electronic equipment comprising a memory and a processor.

The memory stores a computer program, and the processor executes the computer program to perform a white balance adjusting method comprising:

obtaining a first image parameter of a panel under test;

obtaining a white balance compensation factor of the panel under test based on the first image parameter of the panel under test;

using a gamma value of the panel under test as a first threshold value to obtain a first target luminance of the panel under test;

obtaining a second target luminance of the panel under test based on the white balance compensation factor and the first target luminance of the panel under test; and obtaining grayscale voltages corresponding to sub-pixels of the panel under test based on the second target luminance of the panel under test.

In the electronic equipment, the step of obtaining the first image parameter of the panel under test comprises:

scanning the panel under test to obtain a luminance value $L_R(i)$ of an R sub-pixel, a luminance value $L_G(i)$ of a G sub-pixel, a luminance value $L_B(i)$ of a B sub-pixel, and a luminance value $L_W(i)$ of a W sub-pixel of the panel under test at an i-th gray level.

In the electronic equipment, the step of obtaining the white balance compensation factor of the panel under test based on the first image parameter of the panel under test comprises:

obtaining a luminance value $L_R(M)$ of an R sub-pixel, a luminance value $L_G(M)$ of a G sub-pixel, a luminance value $L_B(M)$ of a B sub-pixel, and a luminance value $L_W(M)$ of a W sub-pixel of the panel under test at an M-th gray level;

obtaining a luminance value $L_R(n)$ of an R sub-pixel, a luminance value $L_G(n)$ of a G sub-pixel, a luminance value $L_B(n)$ of a B sub-pixel, and a luminance value $L_W(n)$ of a W sub-pixel of the panel under test at an n-th gray level;

obtaining a luminance value $L_P$ of a pixel of the panel under test at a dim state;

obtaining a compensation factor $a=\{(L_R(M)+L_R(M)+L_R(M)-2L_P)/L_W(M)\}/\{(L_R(n)+L_R(n)+L_R(n)-2L_P)/L_W(n)\}$ of the panel under test at the n-th gray level;

wherein n is an integer among zero to M.

In the electronic equipment, the step of using the gamma value of the panel under test as the first threshold value to obtain the first target luminance of the panel under test comprises:

using the gamma value of the panel under test as the first threshold value to obtain the first target luminance of the panel under test; and normalizing the first target luminance to obtain a first normalized target luminance of the panel under test.

In the electronic equipment, before the step of obtaining the grayscale voltages corresponding to sub-pixels of the panel under test based on the second target luminance of the panel under test, the method further comprises:

converting the first image parameter of the panel under test from a low bit depth to a high bit depth using a first function to obtain a second image parameter of the panel under test.

In the electronic equipment, the step of obtaining the grayscale voltages corresponding to sub-pixels of the panel under test based on the second target luminance of the panel under test comprises:

obtaining corresponding luminance values of a first sub-pixel among RGB sub-pixels of the panel under test at gray levels based on the second normalized target luminance of the panel under test;

obtaining corresponding luminance values of a second sub-pixel and a third sub-pixel among RGB sub-pixels of the panel under test at gray levels based on the corresponding luminance values of the first sub-pixel at gray levels and the second image parameter of the panel under test;

obtaining grayscale voltages for the first sub-pixel, second sub-pixel, and the third sub-pixel at gray levels based on the corresponding luminance values of first sub-pixel, the second sub-pixel, and the third sub-pixel at gray levels.

wherein the first sub-pixel, the second sub-pixel, and the third sub-pixel are different ones of an R sub-pixel, a G sub-pixel, and a B sub-pixel of the panel under test.

Beneficial Effects:

The present application eliminates the impact of low voltage corresponding to the dark sub-pixels on high voltage corresponding to the bright sub-pixels when RGB sub-pixels are displayed individually, and improves the display quality by processing original image parameters to obtain the white balance compensation factor of the panel under test, obtaining a target luminance of the panel under test based on the white balance compensation factor and the target luminance obtained from the predetermined gamma value.

DETAILED DESCRIPTION OF PREFERRED EMBODIMENTS

The following is detailed description of the application with reference to the drawings in the embodiments of the application for clearly and specifically manifest the objectives, technical solutions, and effects of this application. Note that the embodiments described are only for illustrating and not limiting this application.

In current displays, when RGB sub-pixels are displayed individually, low voltages corresponding to two sub-pixels in a low grayscale state will affect high voltages of sub-pixels in a high grayscale state, resulting in a decrease in brightness of one of RGB sub-pixels. When W sub-pixel is displayed, the RGB sub-pixels are fully lit, which means that the three RGB sub-pixels correspond to the high voltage, and the influence on the brightness between the three RGB sub-pixels is small. That is, W has high luminance. Therefore, in current displays, when all of the WRGB sub-pixels are all in a given grayscale, the luminance of W is not equal to a sum of the luminance of the three RGB sub-pixels, which affects the display quality of the display. To address the technical problem, the present invention provides a white balance and device.

Figure 1:
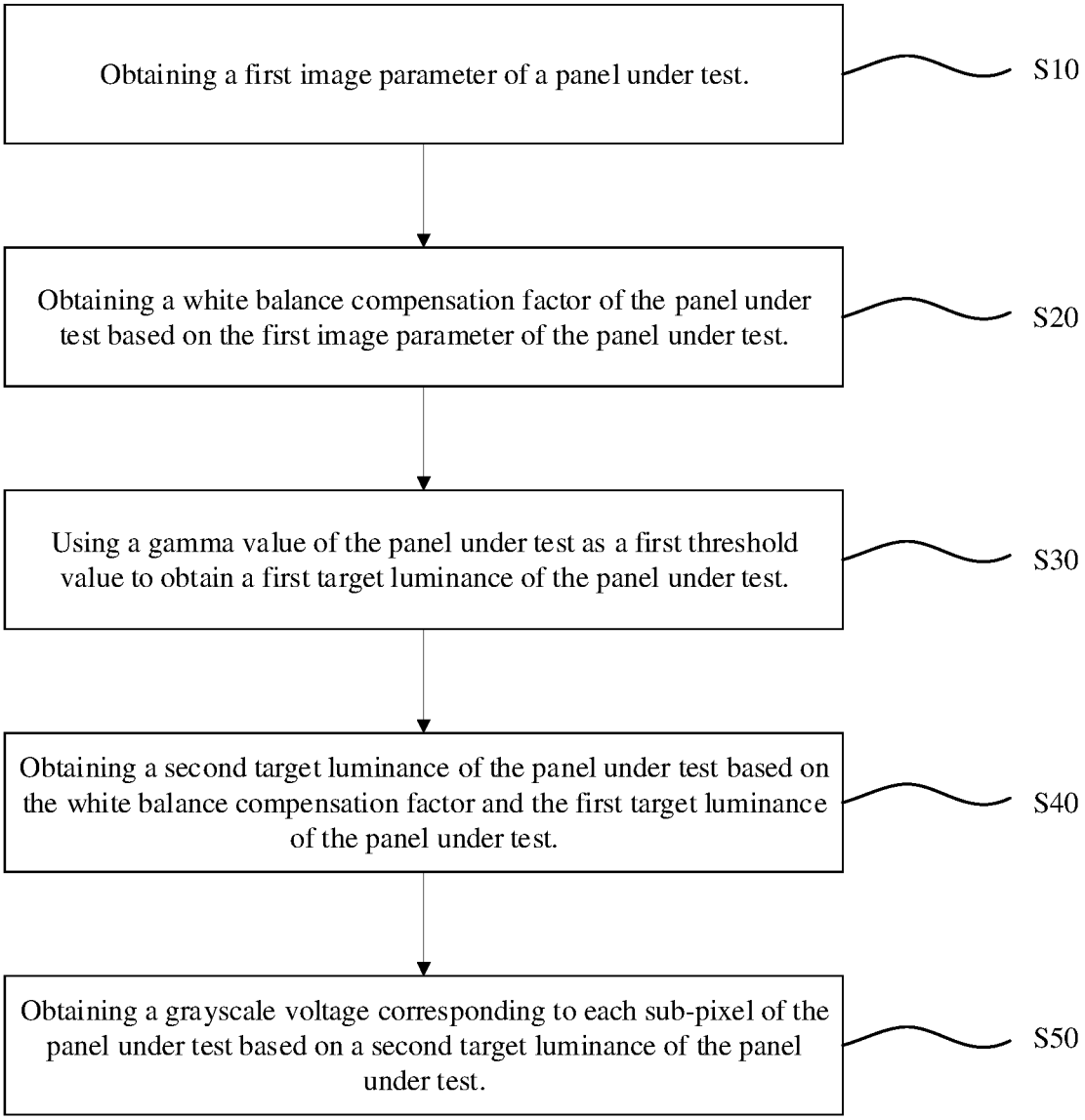
FIG. 1 is a schematic view showing steps of a white balance adjusting method of the present invention.

With reference to FIG. 1, the white balance adjusting method comprises:

S10: obtaining a first image parameter of a panel under test;

In this step, a first image parameter of the panel under test is obtained by means of a scanning device, a reader device, and the similar, which is not specifically limited in the present application.

The step is to obtain corresponding luminance values of sub-pixels of the panel under test at gray levels, such as a luminance value $L_R(i)$ of an R sub-pixel, a luminance value $L_G(i)$ of a G sub-pixel, a luminance value $L_B(i)$ of a B sub-pixel, and a luminance value $L_W(i)$ of a W sub-pixel of the panel under test at an i-th gray level.

In the embodiment, i is an integer selected from zero to M, where M may be $2^8$-1 or $2^{10}$-1, which is not specifically limited in the present application.

For example, an 8-bit display panel under test contains 256 grayscales. A red sub-pixel contains 256 grayscales from 0 to 255, with each grayscale corresponding to a luminance value. Similarly, for a green sub-pixel, a blue sub-pixel, and a white sub-pixel, each sub-pixel has 256 grayscales. Thus, an 8-bit display panel under test has 1024 grayscale values which can be obtained by in the step through a corresponding device.

S20: obtaining a white balance compensation factor of the panel under test based on the first image parameter of the panel under test.

In the embodiment, the step S20 may comprise:

S201: obtaining a luminance value $L_R(M)$ of an R sub-pixel, a luminance value $L_G(M)$ of a G sub-pixel, a luminance value $L_B(M)$ of a B sub-pixel, and a luminance value $L_W(M)$ of a W sub-pixel of the panel under test at an M-th gray level; and S202: obtaining a luminance value $L_R(n)$ of an R sub-pixel, a luminance value $L_G(n)$ of a G sub-pixel, a luminance value $L_B(n)$ of a B sub-pixel, and a luminance value $L_W(n)$ of a W sub-pixel of the panel under test at an n-th gray level.

From the data obtained in step S10, this step can easily obtain the luminance value corresponding to any sub-pixel of the panel under test at any gray level.

In the step S201, an example of 8 bits allows M to be 255. Hence, the step S201 is for obtaining a luminance value $L_R(255)$ of an R sub-pixel, a luminance value $L_G(255)$ of a G sub-pixel, a luminance value $L_B(255)$ of a B sub-pixel, and a luminance value $L_W(255)$ of a W sub-pixel of the panel under test at an 255-th gray level.

S203: obtaining a luminance value $L_P$ of a pixel of the panel under test at a dim state.

S204: obtaining a compensation factor $a=\{(L_R(M)+L_R(M)+L_R(M)-2L_P)/L_W(M)\}/\{(L_R(n)+L_R(n)+L_R(n)-2L_P)/L_W(n)\}$ of the panel under test at the n-th gray level.

In step S203, for an LCD display panel, since the backlight is in a state of constant light, and sub-pixels of the display panel in the dim state have substantial light transmittance, when the panel under test display performs single sub-pixel display test, for example, when the red sub-pixels are displayed, the green and blue sub-pixels are in the dim state, grayscale luminance corresponding to the green sub-pixels should also be subtracted by the luminance values of the green and blue sub-pixels in the dark state introduced by the panel light transmittance.

Figure 2:
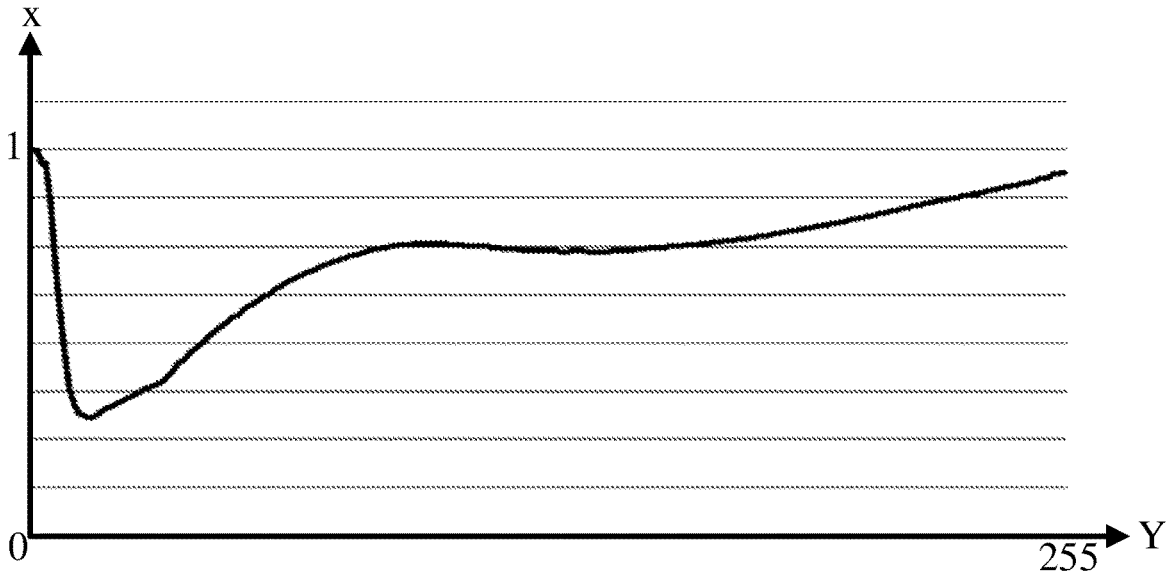
FIG. 2 is a schematic view showing a curve representing ratios of (R+G+B) to W for gray scales in the white balance adjusting method of the present invention.

Additionally, in step S202, the luminance of six sub-pixels in the dim state should be subtracted from the value of $L_R(n)+L_R(n)+L_R(n)$, and luminance of three sub-pixels in the dim state is equal to luminance of one pixel in the dim state. Thus, in step S204, the value of $(L_R(n)+L_R(n)+L_R(n)-2L_P)/L_W(n)$ is the ratio of a sum of luminance values of sub-pixels of respective colors of the panel under test at the n-th gray level in the bright state to the luminance value of the white sub-pixel when all three sub-pixels are in the bright state. FIG. 2 shows the ratio, where the X direction is the grayscale value and the Y direction is the ratio of (R+G+B) to W.

To ensure that the sum of the luminance values of the sub-pixels of respective colors at any given grayscale is equal to the luminance of the white sub-pixel when all three sub-pixels are in the bright state, the curve in FIG. 2 is compensated to 100%, and a compensation factor $a=\{(L_R(255)+L_R(255)+L_R(255)-2L_P)/L_W(255)\}/\{(L_R(n)+L_R(n)+L_R(n)-2L_P)/L_W(n)\}$ can be accordingly obtained specifically for the n-th grayscale of the panel under test.

In the embodiment, n is an integer selected from zero to M.

S30: using a gamma value of the panel under test as a first threshold value to obtain a first target luminance of the panel under test.

In the embodiment, the step S30 may comprise:

S301: using the gamma value of the panel under test as the first threshold value to obtain the first target luminance of the panel under test; and S302: normalizing the first target luminance to obtain a first normalized target luminance of the panel under test.

Step S301 is mainly used to obtain a curve representing target luminance of the panel under test.

This step mainly introduces the concept of gamma value in the field of display technologies, which is a curve chart between grayscales and luminance of the display panel, and different gamma values correspond to different curve charts.

Take the 8-bit panel under test for example, a formula associating the gamma value with grayscales and luminance values is $L=(n/255)^{\gamma}$.

In the formula, L represents a luminance value, n represents a gray level, and γ represents a gamma value.

Thus, with a predetermined gamma value, the embodiment may obtain a luminance value corresponding to any gray level of the panel under test as the first target luminance.

In this embodiment, the first threshold value may be an arbitrary value, which is not specifically limited herein.

In this embodiment, the first threshold value may be 2.2.

S40: obtaining a second target luminance of the panel under test based on the white balance compensation factor and the first target luminance of the panel under test.

The step firstly obtains the white balance compensation factor of the panel under test in step S20 and the first normalized target luminance of the panel under test in step S30, and subsequently obtains a second normalized target luminance of the panel under test based on a ratio of the first normalized target luminance and the white balance compensation factor of the panel under test.

Before step S50, the white balance adjusting method may include:

converting the first image parameter of the panel under test from a low bit depth to a high bit depth using a first function to obtain a second image parameter of the panel under test.

For example, the data of the aforementioned image parameter is 8-bit data, and this step is for converting 8-bit data to a higher bit depth. A first function is used to convert the first image parameter of the panel under test from 8-bit to 10-bit to obtain a second image parameter of the panel under test.

In this embodiment, the difference between the values of the higher bit depth and the lower bit depth is no less than 2.

The 8-bit first image parameter includes a total of 256 grayscales from 0 to 255, while the 10-bit image parameter includes a total of 1024 grayscales from 0 to 1023. The embodiment may, but is not limited to, convert the first image parameter from 8-bit to 10-bit using an interpolation method, that is, inserting several grayscale values into two adjacent grayscales in the 8-bit image parameter, making the second image parameter more refined compared to the first image parameter.

S50: obtaining grayscale voltages corresponding to sub-pixels of the panel under test based on the second target luminance of the panel under test.

In the embodiment, step S50 may include:

S501: obtaining corresponding luminance values of a first sub-pixel among RGB sub-pixels of the panel under test at gray levels based on the second normalized target luminance of the panel under test;

In this step, firstly, a grayscale value corresponding to any compensated luminance value can be obtained based on the second normalized target luminance and $L=(n/255)^{\gamma}$. Secondly, luminance values corresponding to this type of sub-pixels at gray levels is obtained based on a curve relationship between the gray level values and the first type of sub-pixels.

In this embodiment, the curve relationship between the grayscale value and the first type of sub-pixel can be referred to a distribution pattern of the second normalized target luminance described above.

S502: obtaining corresponding luminance values of a second sub-pixel and a third sub-pixel among RGB sub-pixels of the panel under test at gray levels based on the corresponding luminance values of the first sub-pixel at gray levels and the second image parameter of the panel under test;

S503: obtaining grayscale voltages for the first sub-pixel, second sub-pixel, and the third sub-pixel at gray levels based on the corresponding luminance values of first sub-pixel, the second sub-pixel, and the third sub-pixel at gray levels.

In steps S502-S503, by calculating the voltage value applied to the second sub-pixel and the third sub-pixel while keeping fixed the white chromaticity of the display panel at all grayscales, the luminance corresponding to each grayscale on the second normalized target luminance is matched according to the sum of the luminance of the second sub-pixel and the third sub-pixel plus the luminance of the first sub-pixel.

In the embodiment, the first sub-pixel, the second sub-pixel, and the third sub-pixel are different ones of an R sub-pixel, a G sub-pixel, and a B sub-pixel of the panel under test.

In this embodiment, the first sub-pixel is a G sub-pixel. Since the green sub-pixel has a greater influence on white brightness, the voltage of each grayscale of the G sub-pixel is calculated preferentially when performing calculation for the matching.

In the embodiment, since the grayscale luminance of the compensated original image parameters will change substantially, and may have mismatched grayscale luminance in the original image parameters, the present application converts the original image data from a low bit depth to a high bit depth to expand a search range for the matching when performing calculation for the matching of the grayscale voltages of the RGB sub-pixels.

The present application eliminates the impact of low voltage corresponding to the dark sub-pixels on high voltage corresponding to the bright sub-pixels when RGB sub-pixels are displayed individually, and improves the display quality by processing original image parameters to obtain the white balance compensation factor of the panel under test, obtaining a target luminance of the panel under test based on the white balance compensation factor and the target luminance obtained from the predetermined gamma value.

Figure 3:
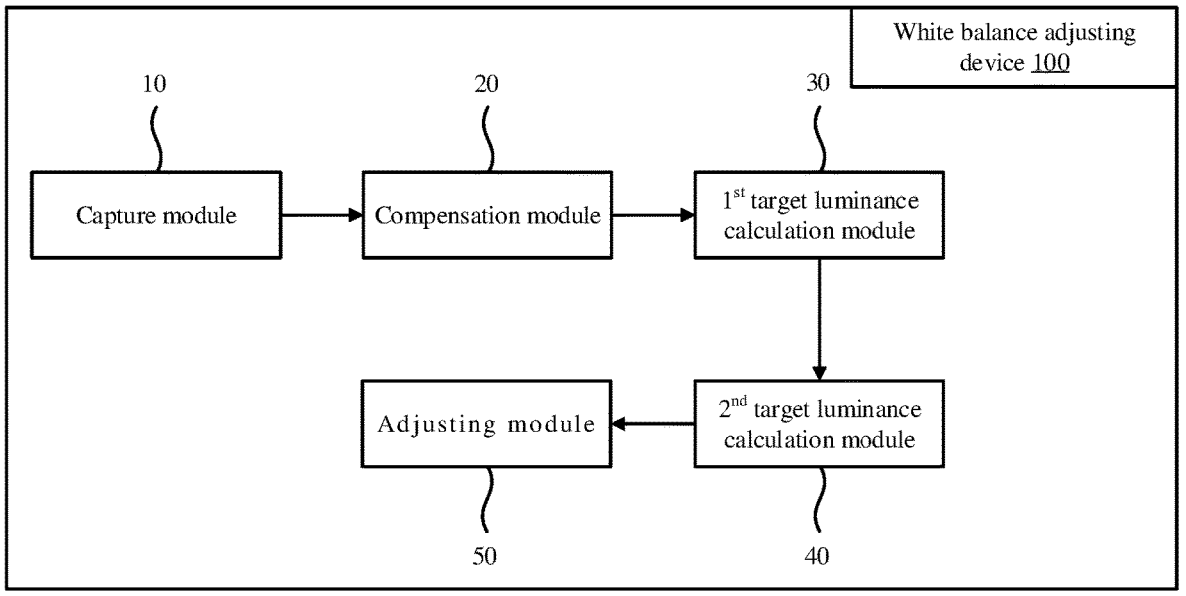
FIG. 3 is a schematic view showing a first structure of the white balance adjusting method of the present invention.

With reference to FIG. 3, the present application further provides a white balance adjusting device 100 comprising a capture module 10, a compensation module 20, a first luminance calculation module 30, a second luminance calculation module 40, and an adjusting module 50.

The capture module 10 obtains a first image parameter of a panel under test.

The compensation module 20 obtains a white balance compensation factor of the panel under test based on the first image parameter of the panel under test.

The first luminance calculation module 30 uses a gamma value of the panel under test as a first threshold value to obtain a first target luminance of the panel under test.

The second luminance calculation module 40 obtains a second target luminance of the panel under test based on the white balance compensation factor and the first target luminance of the panel under test.

The adjusting module 50 obtains grayscale voltages corresponding to sub-pixels of the panel under test based on the second target luminance of the panel under test.

Figure 4:
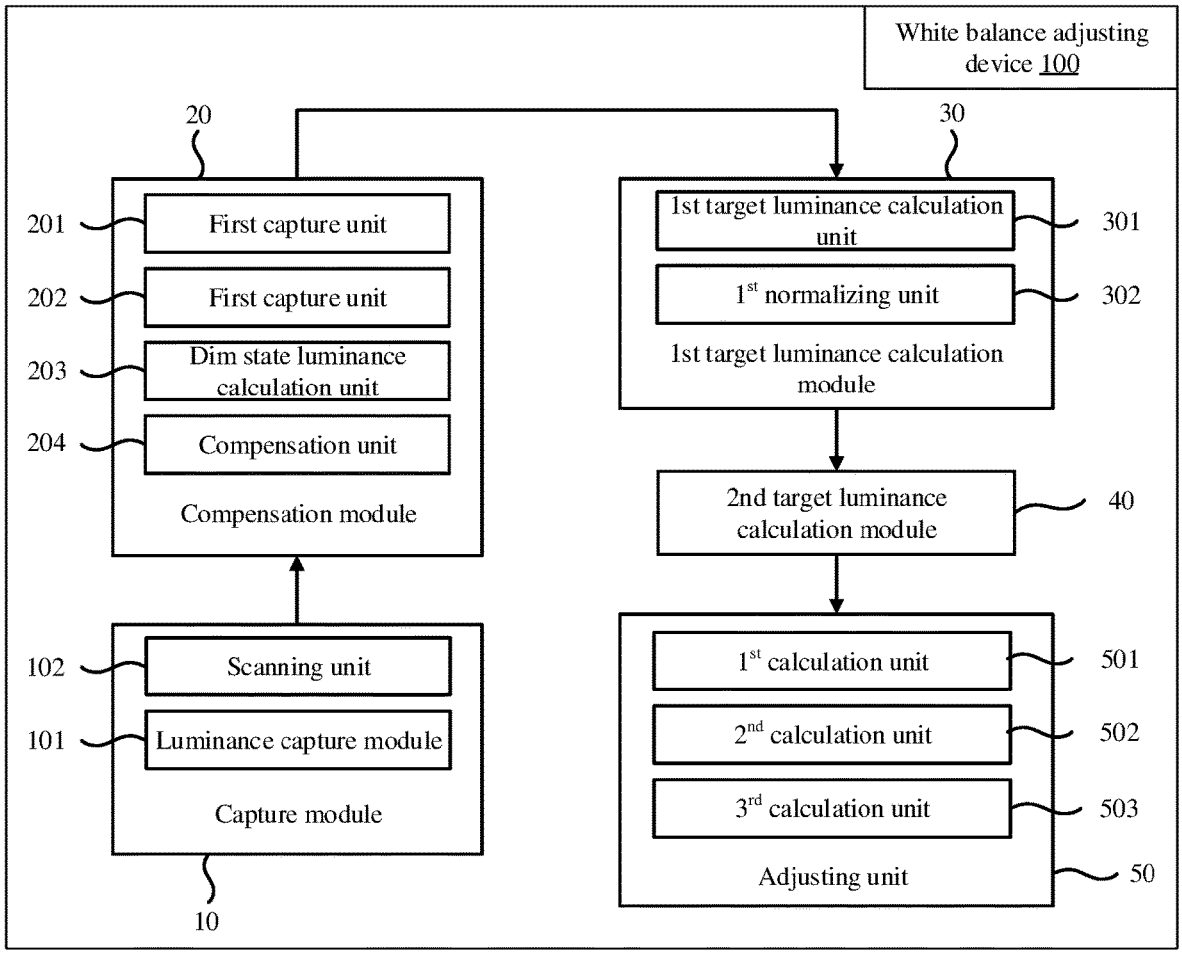
FIG. 4 is a schematic view showing a second structure of the white balance adjusting method of the present invention.

With reference to FIG. 4, the capture module 10 comprises a scanning unit 102 and a luminance acquisition unit 101.

The scanning unit 102 is configured for scanning the panel under test.

The luminance acquisition unit 101 scans the panel under test to obtain a luminance value LR(i) of an R sub-pixel, a luminance value LG(i) of a G sub-pixel, a luminance value LB(i) of a B sub-pixel, and a luminance value LW(i) of a W sub-pixel of the panel under test at an i-th gray level. The i is an integer selected from 0 to M.

With reference to FIG. 4, the compensation module 20 comprises a first capture unit 201, a second capture unit 202, a dim state luminance calculation unit 203, and a compensation unit 204.

The first capture unit 201 obtains a luminance value $L_R(M)$ of an R sub-pixel, a luminance value $L_G(M)$ of a G sub-pixel, a luminance value $L_B(M)$ of a B sub-pixel, and a luminance value $L_W(M)$ of a W sub-pixel of the panel under test at an M-th gray level.

The second capture unit 202 obtains a luminance value $L_R(n)$ of an R sub-pixel, a luminance value $L_G(n)$ of a G sub-pixel, a luminance value $L_B(n)$ of a B sub-pixel, and a luminance value $L_W(n)$ of a W sub-pixel of the panel under test at an n-th gray level.

The dim state luminance calculation unit 203 obtains a luminance value $L_P$ of a pixel of the panel under test at a dim state.

The compensation unit 204 obtains a compensation factor $a=\{(L_R(M)+L_R(M)+L_R(M)-2L_P)/L_W(M)\}/\{(L_R(n)+L_R(n)+L_R(n)-2L_P)/L_W(n)\}$ of the panel under test at the n-th gray level.

With reference to FIG. 4, the first luminance calculation module 30 comprises a first target luminance calculation module 301 and a first normalizing unit 302.

The first target luminance calculation module 301 uses the gamma value of the panel under test as the first threshold value to obtain the first target luminance of the panel under test.

The first normalizing unit 302 normalizes the first target luminance to obtain a first normalized target luminance of the panel under test.

In the embodiment, the second target luminance calculation module 40 obtains a second normalized target luminance of the panel under test based on a ratio of the first normalized target luminance and the white balance compensation factor of the panel under test.

Figure 5:
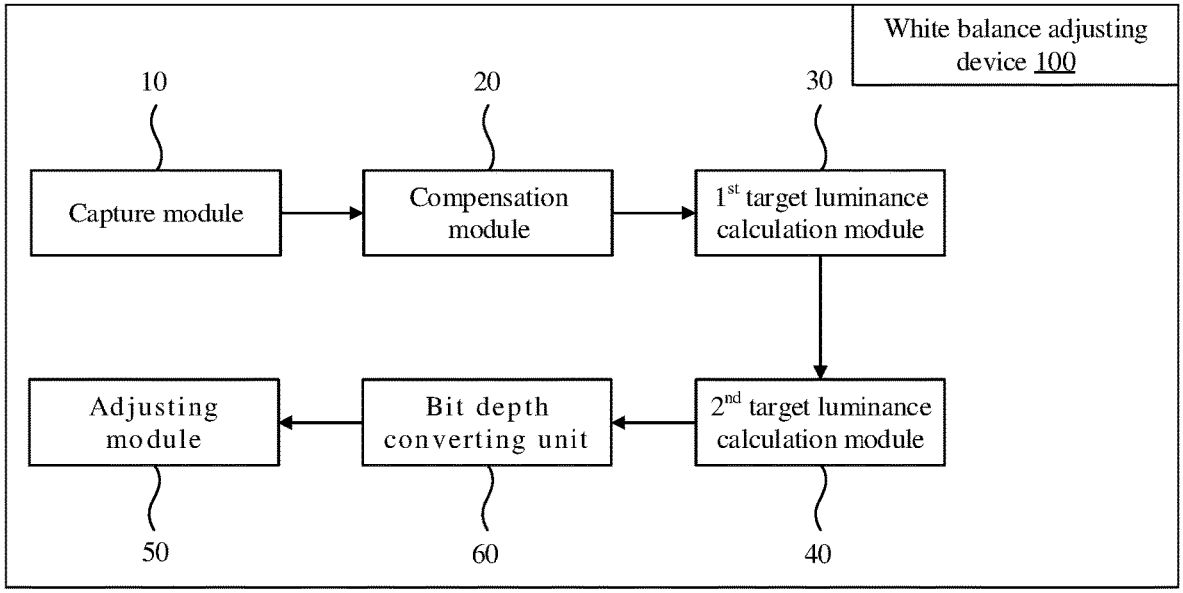
FIG. 5 is a schematic view showing a third structure of the white balance adjusting method of the present invention.

With reference to FIG. 5, the white balance adjusting device 100 further comprises a bit depth converting module 60.

The bit depth converting module 60 converts the first image parameter of the panel under test from a low bit depth to a high bit depth using a first function to obtain a second image parameter of the panel under test.

With reference to FIG. 4, the adjusting module 50 comprises a first calculation unit 501, a second calculation unit 502, and a third calculation unit 503.

The first calculation unit 501 obtains corresponding luminance values of a first sub-pixel among RGB sub-pixels of the panel under test at gray levels based on the second normalized target luminance of the panel under test.

The second calculation unit 502 obtains corresponding luminance values of a second sub-pixel and a third sub-pixel among RGB sub-pixels of the panel under test at gray levels based on the corresponding luminance values of the first sub-pixel at gray levels and the second image parameter of the panel under test.

The third calculation unit 503 obtains grayscale voltages for the first sub-pixel, second sub-pixel, and the third sub-pixel at gray levels based on the corresponding luminance values of first sub-pixel, the second sub-pixel, and the third sub-pixel at gray levels.

Specifically, the first sub-pixel, the second sub-pixel, and the third sub-pixel are different ones of an R sub-pixel, a G sub-pixel, and a B sub-pixel of the panel under test.

In the embodiment, operation of the white balance adjusting device can be referred to the above-mentioned white balance adjusting method and will not be repeated in detail herein.

The present application further proposes an electronic device comprising a memory and a processor.

In this embodiment, the memory stores a computer program. The processor executes the computer program to implement the white balance adjusting method described above, which is not repeated herein.

The present application also proposes a computer-readable storage medium storing a computer program, which when being executing by the processor, implements the above-mentioned white balance adjusting method, and is not repeated herein.

The present application provides a white balance adjusting method, device, and electronic equipment. The method includes obtaining a first image parameter of a panel under test; obtaining a white balance compensation factor of the panel under test based on the first image parameter of the panel under test; using a gamma value of the panel under test as a first threshold value to obtain a first target luminance of the panel under test; obtaining a second target luminance of the panel under test based on the white balance compensation factor and the first target luminance of the panel under test; and obtaining grayscale voltages corresponding to sub-pixels of the panel under test based on the second target luminance of the panel under test. The application eliminates the impact of low voltage corresponding to the dark sub-pixels on high voltage corresponding to the bright sub-pixels when RGB sub-pixels are displayed individually, and improves the display quality by processing original image parameters to obtain the white balance compensation factor of the panel under test, obtaining a target luminance of the panel under test based on the white balance compensation factor and the target luminance obtained from the predetermined gamma value.

As can be appreciated, a person with ordinary skill in the art may apply equivalent substitution or modification based on the technical solutions and invention of the application. Such equivalent substitution or modification are included in the scope of claims accompanying the application.

What is claimed is:

1. A white balance adjusting method, comprising following steps:

obtaining a first image parameter of a panel under test;

obtaining a white balance compensation factor of the panel under test based on the first image parameter of the panel under test;

using a gamma value of the panel under test as a first threshold value to obtain a first target luminance of the panel under test;

obtaining a second target luminance of the panel under test based on the white balance compensation factor and the first target luminance of the panel under test; and obtaining grayscale voltages corresponding to sub-pixels of the panel under test based on the second target luminance of the panel under test;

wherein the step of using the gamma value of the panel under test as the first threshold value to obtain the first target luminance of the panel under test comprises:

using the gamma value of the panel under test as the first threshold value to obtain the first target luminance of the panel under test; and normalizing the first target luminance to obtain a first normalized target luminance of the panel under test;

wherein the step of obtaining the second target luminance of the panel under test based on the white balance compensation factor and the first target luminance of the panel under test comprises:

obtaining a second normalized target luminance of the panel under test based on a ratio of the first normalized target luminance and the white balance compensation factor of the panel under test.

2. The white balance adjusting method of claim 1, wherein the step of obtaining the first image parameter of the panel under test comprises:

scanning the panel under test to obtain a luminance value $L_R(i)$ of an R sub-pixel, a luminance value $L_G(i)$ of a G sub-pixel, a luminance value $L_B(i)$ of a B sub-pixel, and a luminance value $L_W(i)$ of a W sub-pixel of the panel under test at an i-th gray level.

3. The white balance adjusting method of claim 2, wherein the step of obtaining the white balance compensation factor of the panel under test based on the first image parameter of the panel under test comprises:

obtaining a luminance value $L_R(M)$ of the R sub-pixel, a luminance value $L_G(M)$ of the G sub-pixel, a luminance value $L_B(M)$ of the B sub-pixel, and a luminance value $L_W(M)$ of the W sub-pixel of the panel under test at an M-th gray level;

obtaining a luminance value $L_R(n)$ of the R sub-pixel, a luminance value $L_G(n)$ of the G sub-pixel, a luminance value $L_B(n)$ of the B sub-pixel, and a luminance value $L_W(n)$ of the W sub-pixel of the panel under test at an n-th gray level;

obtaining a luminance value $L_P$ of a pixel of the panel under test at a dim state; and obtaining a compensation factor $a=\{(L_R(M)+L_R(M)+L_R(M)-2L_P)/L_W(M)\}/\{(L_R(n)+L_R(n)+L_R(n)-2L_P)/L_W(n)\}$ of the panel under test at the n-th gray level;

wherein n is an integer among zero to M.

4. The white balance adjusting method of claim 1, wherein before the step of obtaining the grayscale voltages corresponding to sub-pixels of the panel under test based on the second target luminance of the panel under test, the method further comprises:

converting the first image parameter of the panel under test from a low bit depth to a high bit depth using a first function to obtain a second image parameter of the panel under test.

5. The white balance adjusting method of claim 4, wherein the step of obtaining the grayscale voltages corresponding to sub-pixels of the panel under test based on the second target luminance of the panel under test comprises:

obtaining corresponding luminance values of a first sub-pixel among RGB sub-pixels of the panel under test at gray levels based on the second normalized target luminance of the panel under test;

obtaining corresponding luminance values of a second sub-pixel and a third sub-pixel among RGB sub-pixels of the panel under test at gray levels based on the corresponding luminance values of the first sub-pixel at gray levels and the second image parameter of the panel under test; and obtaining grayscale voltages for the first sub-pixel, second sub-pixel, and the third sub-pixel at gray levels based on the corresponding luminance values of first sub-pixel, the second sub-pixel, and the third sub-pixel at gray levels;

wherein the first sub-pixel, the second sub-pixel, and the third sub-pixel are different ones of an R sub-pixel, a G sub-pixel, and a B sub-pixel of the panel under test.

6. An electronic equipment, comprising:

a memory; and a processor;

wherein the memory stores a computer program, and the processor executes the computer program to perform a white balance adjusting method, comprising following steps:

obtaining a first image parameter of a panel under test;

obtaining a white balance compensation factor of the panel under test based on the first image parameter of the panel under test;

using a gamma value of the panel under test as a first threshold value to obtain a first target luminance of the panel under test;

obtaining a second target luminance of the panel under test based on the white balance compensation factor and the first target luminance of the panel under test; and obtaining grayscale voltages corresponding to sub-pixels of the panel under test based on the second target luminance of the panel under test;

wherein the step of using the gamma value of the panel under test as the first threshold value to obtain the first target luminance of the panel under test comprises:

using the gamma value of the panel under test as the first threshold value to obtain the first target luminance of the panel under test; and normalizing the first target luminance to obtain a first normalized target luminance of the panel under test;

wherein the step of obtaining the second target luminance of the panel under test based on the white balance compensation factor and the first target luminance of the panel under test comprises:

obtaining a second normalized target luminance of the panel under test based on a ratio of the first normalized target luminance and the white balance compensation factor of the panel under test.

7. The electronic equipment of claim 6, wherein the step of obtaining the first image parameter of the panel under test comprises:

scanning the panel under test to obtain a luminance value $L_R(i)$ of an R sub-pixel, a luminance value $L_G(i)$ of a G sub-pixel, a luminance value $L_B(i)$ of a B sub-pixel, and a luminance value $L_W(i)$ of a W sub-pixel of the panel under test at an i-th gray level.

8. The electronic equipment of claim 7, wherein the step of obtaining the white balance compensation factor of the panel under test based on the first image parameter of the panel under test comprises:

obtaining a luminance value $L_R(M)$ of the R sub-pixel, a luminance value $L_G(M)$ of the G sub-pixel, a luminance value $L_B(M)$ of the B sub-pixel, and a luminance value $L_W(M)$ of the W sub-pixel of the panel under test at an M-th gray level;

obtaining a luminance value $L_R(n)$ of the R sub-pixel, a luminance value $L_G(n)$ of the G sub-pixel, a luminance value $L_B(n)$ of the B sub-pixel, and a luminance value $L_W(n)$ of the W sub-pixel of the panel under test at an n-th gray level;

obtaining a luminance value $L_P$ of a pixel of the panel under test at a dim state; and obtaining a compensation factor $a=\{(L_R(M)+L_R(M)+L_R(M)-2L_P)/L_W(M)\}/\{(L_R(n)+L_R(n)+L_R(n)-2L_P)/L_W(n)\}$ of the panel under test at the n-th gray level;

wherein n is an integer among zero to M.

9. The electronic equipment of claim 6, wherein before the step of obtaining the grayscale voltages corresponding to sub-pixels of the panel under test based on the second target luminance of the panel under test, the method further comprises:

converting the first image parameter of the panel under test from a low bit depth to a high bit depth using a first function to obtain a second image parameter of the panel under test.

10. The electronic equipment of claim 9, wherein the step of obtaining the grayscale voltages corresponding to sub-pixels of the panel under test based on the second target luminance of the panel under test comprises:

obtaining corresponding luminance values of a first sub-pixel among RGB sub-pixels of the panel under test at gray levels based on the second normalized target luminance of the panel under test;

obtaining corresponding luminance values of a second sub-pixel and a third sub-pixel among RGB sub-pixels of the panel under test at gray levels based on the corresponding luminance values of the first sub-pixel at gray levels and the second image parameter of the panel under test; and obtaining grayscale voltages for the first sub-pixel, second sub-pixel, and the third sub-pixel at gray levels based on the corresponding luminance values of first sub-pixel, the second sub-pixel, and the third sub-pixel at gray levels;

wherein the first sub-pixel, the second sub-pixel, and the third sub-pixel are different ones of an R sub-pixel, a G sub-pixel, and a B sub-pixel of the panel under test.

* * * * *